US006592386B2

(12) United States Patent
Teng et al.

(10) Patent No.: US 6,592,386 B2
(45) Date of Patent: Jul. 15, 2003

(54) SOCKET WHICH CAN BE TIGHTLY CONNECTED WITH A PLUG

(75) Inventors: Wei-Chih Teng, Taipei Hsien (TW); Chien-Chang Chu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 10/063,895

(22) Filed: May 22, 2002

(65) Prior Publication Data

US 2002/0182906 A1 Dec. 5, 2002

(30) Foreign Application Priority Data

May 31, 2001 (TW) ..... 90113265 A

(51) Int. Cl.[7] ..... H01R 29/00
(52) U.S. Cl. ..... 439/172
(58) Field of Search ..... 439/172, 171, 439/518, 332, 333, 334, 342, 670

(56) References Cited

U.S. PATENT DOCUMENTS 5,702,259 A * 12/1997 Lee ..... 439/137
6,328,581 B1 * 12/2001 Lee et al. ..... 439/106

FOREIGN PATENT DOCUMENTS

TW 337384 7/1998

* cited by examiner

*Primary Examiner*—Lynn Field
*Assistant Examiner*—Phuong KT Dinh
(74) *Attorney, Agent, or Firm*—Winston Hsu

(57) ABSTRACT

A plug that is firmly connected with a socket has a pair of parallel prongs and two protruded bases. One side of each protruded base has a receiving hole perpendicular to the parallel prongs. The socket has two slots corresponding to the two protruded bases. One side of each slot has a horizontal pin for inserting into a corresponding receiving hole. After the protruded bases are positioned on the slots of the socket, the plug can be rotated to insert the horizontal pins into the receiving holes.

13 Claims, 6 Drawing Sheets

SOCKET WHICH CAN BE TIGHTLY CONNECTED WITH A PLUG

BACKGROUND OF INVENTION

1. Field of the Invention

The present invention relates to an electric socket, and more specifically to an electric socket that can be connected firmly with a dismountable plug.

2. Description of the Prior Art

Electronic equipment has become a necessity for humans. Most electronic equipment whether it is located at home, offices, or hotels requires a power transformer which converts AC power from the socket on the wall to DC power. This kind of power transformer is used to reduce the dependence on batteries, or to provide a DC power to charge rechargeable batteries. In order to provide power, the power transformer must use power transformation circuitry inside a body of the power transformer and a plug installed onto the body. The plug is used to mate with the socket, which supplies power. However, there is a serious problem for people who often travel to different foreign countries. Power standards are not uniform worldwide.

It is difficult to use electronic equipment worldwide because of different voltages and frequencies in different countries. Similarly, the sockets installed on the wall may have different specifications. Power transformation circuitry has been developed to perform AC-to-DC power transformation worldwide. However, the power transformation circuitry does not work if used with an unsuitable socket.

Please refer to FIG. 1, which is a diagram of a prior art adapter (U.S. Pat. No. 6,109,977). The adapter 10 comprises a housing 14 and a pair of parallel prongs 12 rotatably installed on the housing 14 for connecting with a plug. As shown in FIG. 1, when the shape of the prongs 12 matches with the socket on the wall, the prongs 12 can be rotated to the position A for connecting with the socket on the wall.

Please refer to FIG. 2, which is a diagram of the prior art adapter 10 shown in FIG. 1 and different plugs 16, 18, 22. For use with diverse socket standards in different countries, the prongs 12 can be transformed to another shape. When the prongs 12 are rotated to a position B, different plugs 16, 18, 22 can be connected. As shown in FIG. 2, when the prongs 12 are positioned at the position B, the user can connect the prongs 12 with one of the plugs 16, 18, 22 according to the specification of the socket on the wall. In this way, the adapter 10 is capable of plugging into different shapes of sockets on the wall using plugs 16, 18, 22. However, the connection between the adapter 10 and the plugs 16, 18, 22 formed by plugging the prongs 12 into the holes 24 of the plugs 16, 18, 22 is not stable. Therefore, the adapter 10 may separate from the plugs 16, 18, 22 while plugged into the socket on the wall.

SUMMARY OF INVENTION

It is therefore a primary objective of the present invention to provide a dismountable plug with parallel prongs and protruded bases to solve the above-mentioned problem.

In a preferred embodiment, the present invention provides a plug that can be connected with a socket. The plug comprises a pair of parallel prongs and two protruded bases. One side of each protruded base has a receiving hole perpendicular to the parallel prongs. The socket has two slots corresponding to the two protruded bases. One side of each slot has a horizontal pin for inserting into a corresponding receiving hole. After the protruded bases are positioned on the slots of the socket, the plug can be rotated to insert the horizontal pins into the receiving holes. It is an advantage of the present invention that the dismountable plug can connect firmly with the socket for improving the durability of the dismountable plug.

These and other objectives of the present invention will no doubt become obvious to those of ordinary skill in the art after reading the following detailed description of the preferred embodiment, which is illustrated in the various figures and drawings.

DETAILED DESCRIPTION

Figure 1:
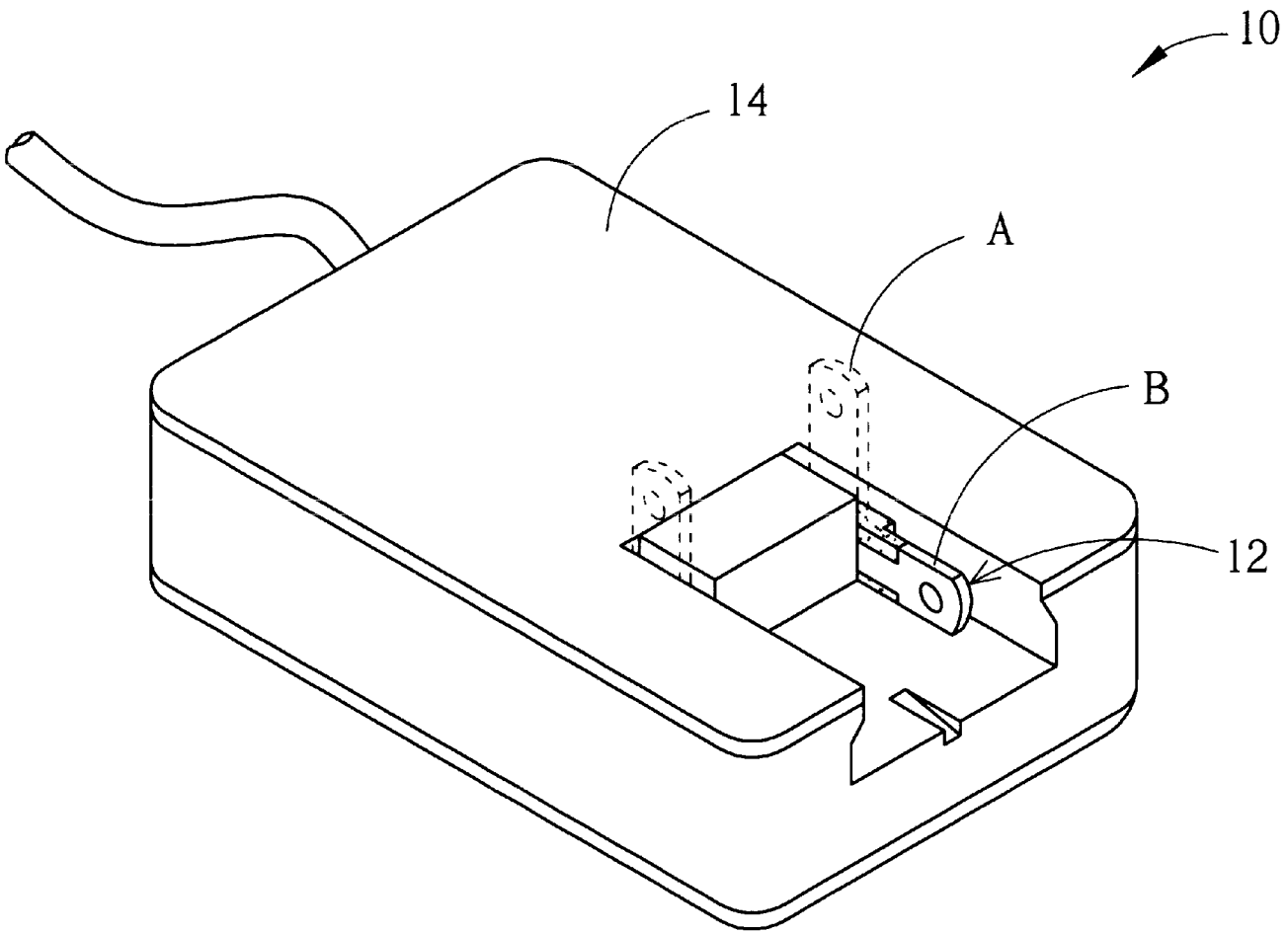
Fig. 1 Prior art
FIG. 1 is a diagram of the prior art adapter.
Figure 2:
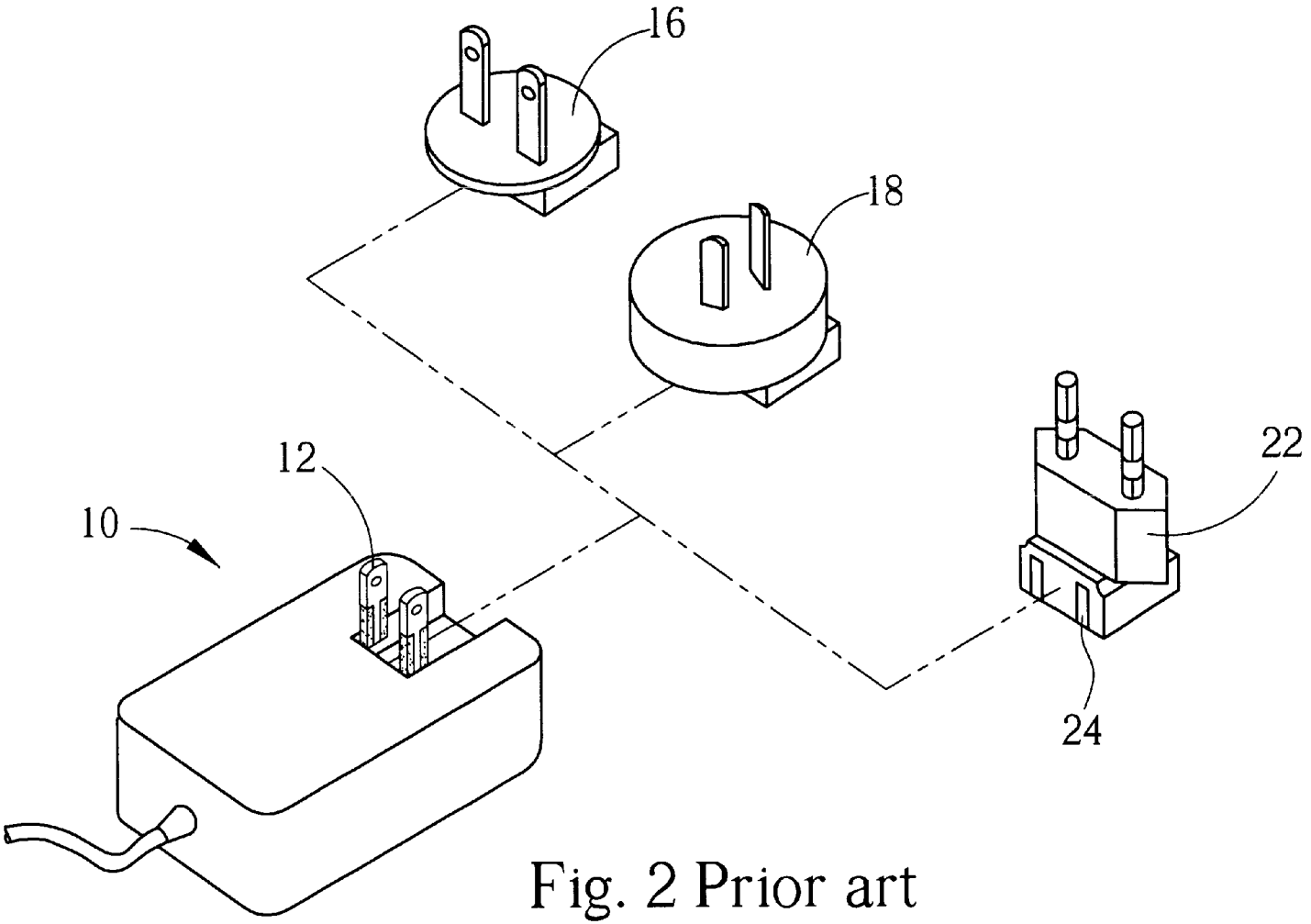
Fig. 2 Prior art
FIG. 2 is a diagram of the prior art adapter shown in FIG. 1 and different plugs.
Figure 3:
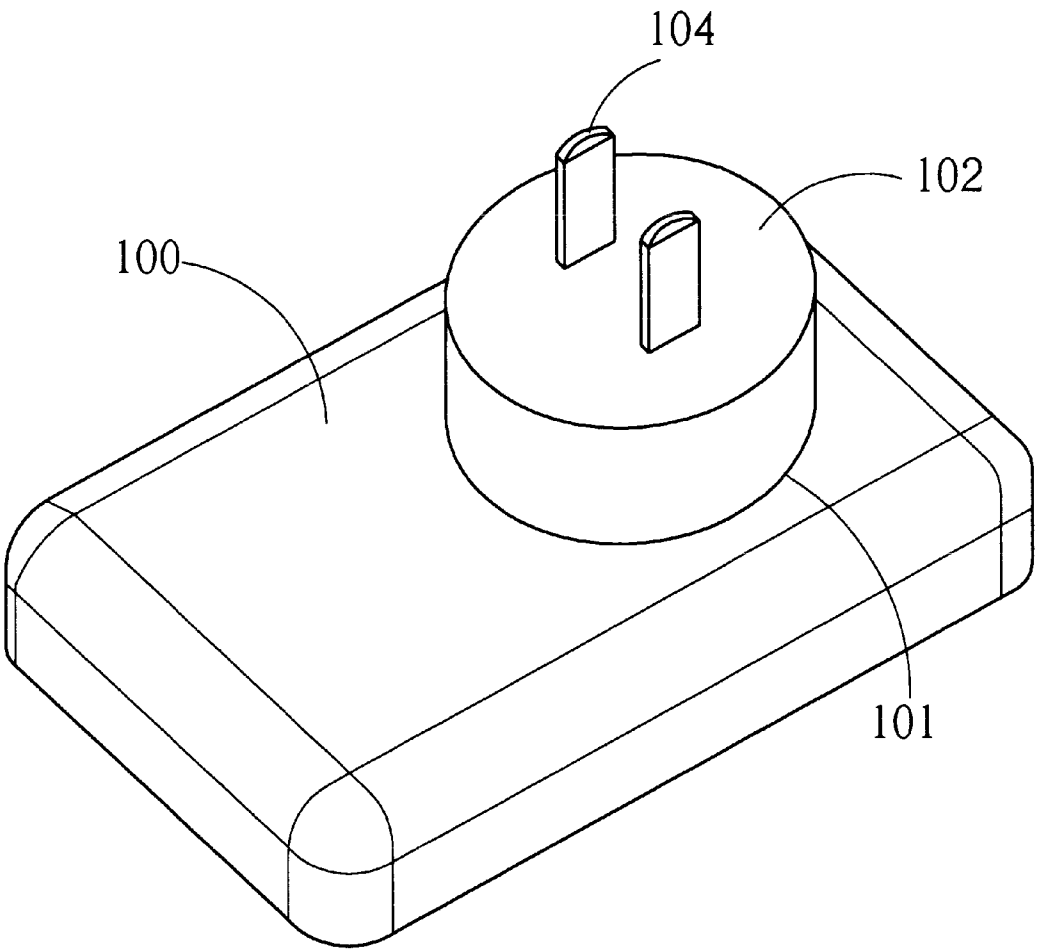
FIG. 3 is a diagram of a dismountable plug adapted to mate with a socket of an adapter according to the present invention.

Please refer to FIG. 3, which is a diagram of a dismountable plug 102 adapted to mate with a socket 101 of a body 100 of electronic equipment according to the present invention. The plug 102 comprises a pair of parallel prongs 104 for mating with a socket on a wall when electrically connected with the body 100 of the electronic equipment. The body 100 of the electronic equipment could be an adapter, a transformer, or other electronic equipment that is portable or designed for travelers specifically.

Figure 4:
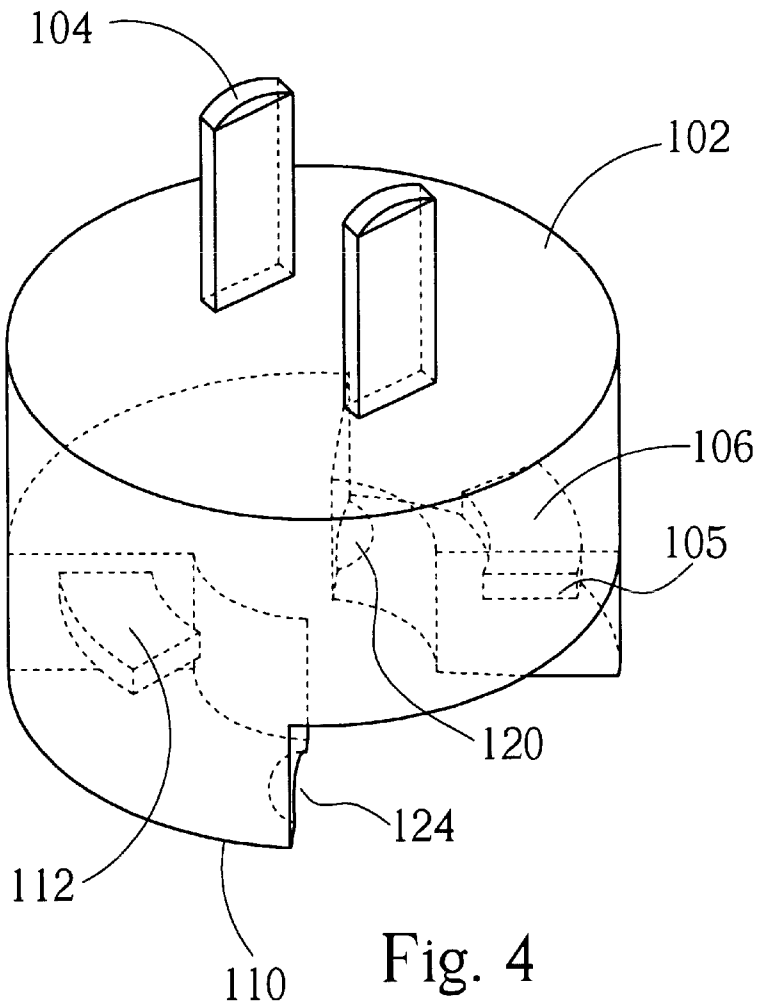
FIG. 4 is a diagram of the dismountable plug shown in FIG. 3.

Please refer to FIG. 4, which is a diagram of the dismountable plug 102. The plug 102 comprises two fan-shaped protruded bases 105, 110 at the bottom of the plug 102, and a receiving hole 106, 112 at one side of each protruded base 105, 110 that is perpendicular to the parallel prongs 104.

Figure 5:
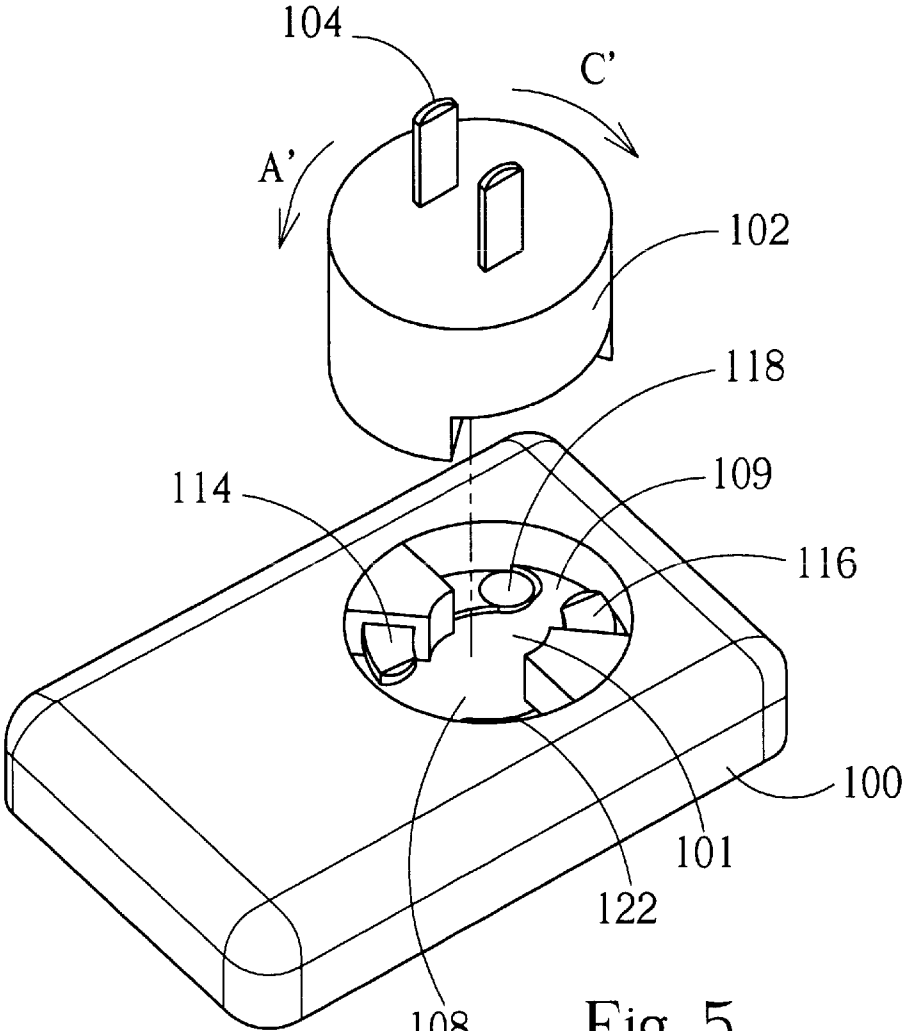
FIG. 5 is a detailed diagram of the dismountable plug and adapter shown in FIG. 3.

Please refer to FIG. 5, which is a detailed diagram of the dismountable plug 102 and the body 100 of the electronic equipment shown in FIG. 3. The plug 101 comprises two fan-shaped slots 108, 109 corresponding to the two fan-shaped protruded bases 105, 110 of the plug 102. There is a fan-shaped horizontal pin 114, 116 installed at one side of each slot 108, 109 adapted to mate with the corresponding receiving hole 106, 112. The horizontal pins 114, 116 and receiving holes 106, 112 can be implemented by molding or fixed by screws. When the protruded bases 105, 110 of the plug 102 are positioned onto the slots 108, 109 of the socket 101, the plug 102 is capable of being rotated along an arc edge of the slots 108, 109 in the rotational direction C" to mate the fan-shaped horizontal pins 114, 116 of the slots 108, 109 with the fan-shaped receiving holes 106, 112 of the protruded bases 105, 110. Then, the parallel prongs 104 are electrically connected with the internal circuitry installed inside the body 100 of the electronic equipment. When the fan-shaped horizontal pins 114, 116 are mated with the fan-shaped receiving holes 106, 112 of the protruded bases 105, 110, the plug 102 is fixed on the socket 101. This means that the user cannot directly pull the plug 102 out of the socket 101 without rotating the plug 102 because of the fan-shaped horizontal pins 114, 116, which are perpendicular to the direction of installing the plug 102 onto the socket 101.

Please refer to FIG. 4 and FIG. 5. The plug 101 further comprises two lock balls 118, 122 installed at the bottom end of the slots 108, 109, and corresponding apertures 120, 124 at the bottom end of the protruded bases 105 110 of the plug 102. When the plug 102 is rotated in the direction C", the horizontal pins 114, 116 of the slots 108, 109 will be inserted into the receiving holes 106, 112 of the protruded bases 105, 110. Then, the lock balls 118, 122 (protruded half ball) will mate with the apertures 120, 124 (caved half ball) to fix the plug 102 onto the socket 101.

In the present embodiment, the location of the lock balls 118, 122 of the slots 108, 109 can also be exchanged with the location of the apertures 120, 124 at the bottom end of the protruded bases 105, 110. In other words, the protruded bases 105, 110 of the plug 102 can have lock balls 118, 122 installed at the bottom end, and the slots 108, 109 of the socket 101 can have corresponding holes 120, 124 installed at the bottom end. When the user rotates the plug 102 in the rotational direction C", the horizontal pins 114, 116 of the slots 108, 109 will be inserted into the receiving holes 106, 112 of the protruded bases 105, 110. Then, the lock balls 118, 122 will mate with the apertures 120, 124 so as to make the plug 102 fixed on the socket 101.

Likewise, the location of the receiving holes 106, 112 of the protruded bases 105, 110 on the plug 102 can be exchanged with the location of the horizontal pins 114, 116 of the slots 108, 109 on the socket 101. In other words, the protruded bases 105, 110 of the plug 102 can have horizontal pins 114, 116 installed at the arc side, with the horizontal pins 114, 116 being perpendicular to the parallel prongs 104. There can be horizontal receiving holes 106, 112 installed at one side of each slot 108, 109 of the socket 101 adapted to mate with the horizontal pins 114, 116.

In a similar manner, the structures of the protruded base and the slot can have locations exchanged with each other. Besides the structures of the protruded base and the slot mentioned above, other combinations of devices could be installed on the plug and the socket according to the present invention. According to the present invention, the plug is electrically connectable with the socket as long as the dismountable plug can be perpendicularly installed on the body of the electronic equipment and horizontally rotated.

Figure 7:
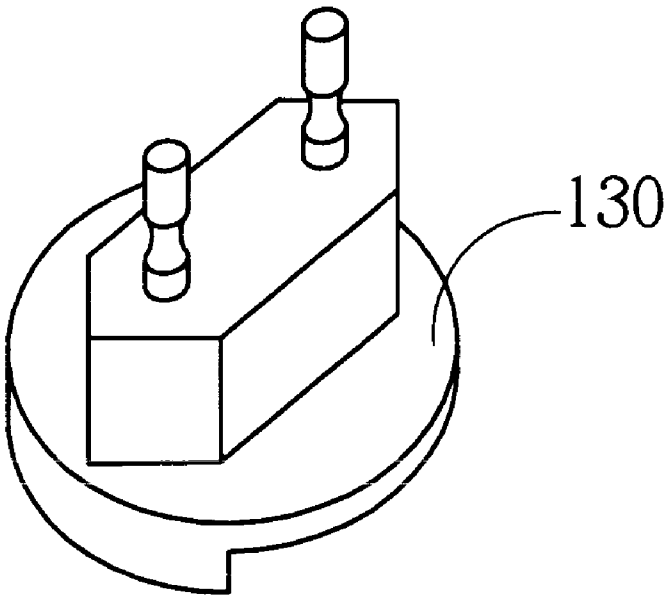
FIG. 6, and FIG. 7 are diagrams of different kinds of plugs.
Figure 6:
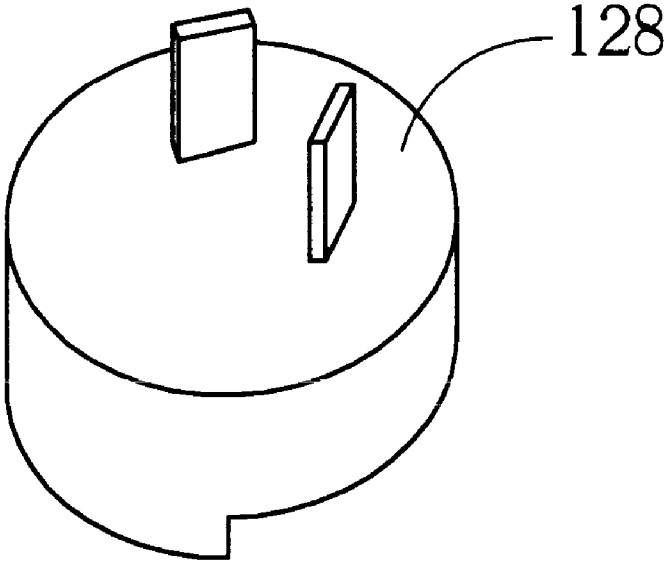

Please refer to FIG. 6 and FIG. 7, with reference to FIG. 5. FIG. 6 and FIG. 7 are diagrams of different kinds of plugs 128, 130. In the present embodiment, bottom structures of the plugs 128, 130 are the same as the bottom structure of the plug 102. When the user wants to use the adapter 100 in different countries or regions, all the user has to do is to replace the plug 102 installed on the adapter 100 with a suitable plug. The user rotates the plug 102 in the direction A", and pulls the plug 102 up. One of the suitable plugs 128, 130 is rotated in the direction C" to mate with the socket 101, fixing the plug 128, 130 onto the adapter 100. In order to prevent the plug from being pulled out directly after being installed, each of the directions A" and C" is perpendicular with the direction of installing each plug on the socket 101.

As compared with the prior art socket 10, the adapter 100 uses the fan-shaped slots 108, 109 of the socket 101 to mate with the fan-shaped protruded bases 105, 110 of the plug 102 to firmly fix the socket 101 and the plug 102. There are also two horizontal receiving holes 106, 112 installed at the arc side of the slots 108, 109 of the socket 101 adapted to mate with the horizontal pins 114, 116 installed at the bottom end of the protruded bases 105, 110 of the plug 102. Moreover, there are two protruded lock balls 118, 122 installed on the socket 101 adapted to mate with two apertures 120, 124 installed at the bottom end of the plug 102 so as to make the connection between the plug 102 and the socket 101 fixed and stable.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An adaptor for connecting to various electrical outlets, the adapter comprising:

a body;

a socket being a substantially cylindrical recess in the body;

at least two first protruded bases protruding from a flat bottom face of the socket;

at least two curved pins, one pin in a flat side of each first protruded base, each pin following the curvature of the socket and substantially parallel to the bottom face of the socket; and a removable plug for connecting to an electrical outlet, the plug comprising:

a substantially cylindrical body capable of fitting and rotating in the socket;

at least two prongs protruding from a first flat face of the cylindrical body for connecting to the electrical outlet;

at least two second protruded bases protruding from a second flat face of the cylindrical body; and at least two curved receiving holes for receiving the curved pins, one receiving hole in a flat side of each second protruded base, each receiving hole following the curvature of the cylindrical body and substantially parallel to the second flat face of the cylindrical body, the receiving holes electrically connected to the prongs;

wherein the plug is capable of being inserted into the socket and rotated relative to the socket such that the curved pins and the curved receiving holes mechanically and electrically mate, thereby electrically connecting the adaptor to the electrical outlet.

2. The adaptor of claim 1 further comprising a lock ball disposed on the bottom face of the socket between the first protruded bases; wherein at least one second protruded base further comprises an aperture disposed on a surface parallel to the second flat face of the cylindrical body for mating with the lock ball.

3. The adaptor of claim 1 further comprising an aperture disposed on the bottom face of the socket between the first protruded bases; wherein at least one second protruded base further comprises a lock ball disposed on a surface parallel to the second flat face of the cylindrical body for mating with the aperture.

4. The adaptor of claim 1 further comprising an electrical connecter electrically connected to the curved pins for connecting the plug to an external electrical device.

5. An adaptor for receiving interchangeable plugs for connecting to various electrical outlets, the adapter comprising:

a body;

a socket being a substantially cylindrical recess in the body;

at least two first protruded bases protruding from a flat bottom face of the socket; and at least two curved pins, one pin in a flat side of each first protruded base, each pin following the curvature of the socket and substantially parallel to the bottom face of the socket;

wherein the curved pins are for mechanically and electrically mating with a specific interchangeable plug for connecting the adaptor a corresponding electrical outlet.

6. The adaptor of claim 5 further comprising a lock ball disposed on the bottom face of the socket between the first protruded bases, the lock ball for mating with an aperture of the plug.

7. The adaptor of claim 5 further comprising an aperture disposed on the bottom face of the socket between the first protruded bases, the aperture for mating with a lock ball of the plug.

8. The adaptor of claim 5 further comprising an electrical connecter electrically connected to the curved pins for connecting the plug to an external electrical device.

9. A plug for removably connecting to an electrical outlet and to the adaptor of claim 5.

10. A plug for connecting to an electrical outlet, the plug comprising:

a substantially cylindrical body;

at least two prongs protruding from a first flat face of the cylindrical body for connecting to the electrical outlet;

at least two second protruded bases protruding from a second flat face of the cylindrical body; and at least two curved receiving holes, one receiving hole in a flat side of each second protruded base, each receiving hole following the curvature of the cylindrical body and substantially parallel to the second flat face of the cylindrical body, the receiving holes electrically connected to the prongs;

wherein the curved receiving holes are for mechanically and electrically mating with a socket of an adaptor for connecting the electrical outlet to the adaptor.

11. The plug of claim 10 wherein at least one second protruded base further comprises an aperture disposed on a surface parallel to the second flat face of the cylindrical body, the aperture for mating with a lock ball of the socket.

12. The plug of claim 10 wherein at least one second protruded base further comprises a lock ball disposed on a surface parallel to the second flat face of the cylindrical body, the lock ball for mating with an aperture of the socket.

13. An adaptor for accepting the plug of claim 10.

* * * * *